United States Patent [19]

Lore

[11] 4,303,054

[45] Dec. 1, 1981

[54] DETACHABLE MAGNETIC BASE FOR MACHINE TOOL TABLE

[75] Inventor: Nicola Lore, Bethpage, N.Y.

[73] Assignee: Lopre Products, Inc., Farmingdale, N.Y.

[21] Appl. No.: 145,726

[22] Filed: May 1, 1980

[51] Int. Cl.[3] ..... B24B 53/12

[52] U.S. Cl. ..... 125/11 R; 33/DIG. 1; 33/169 R; 51/216 R; 248/206 A; 248/DIG. 4; 269/8

[58] Field of Search ..... 269/8; 279/1 M; 51/216 R; 125/11 R; 33/DIG. 1, 169 R; 248/206 A, DIG. 4

[56] References Cited

U.S. PATENT DOCUMENTS

| | | | |
|---|---|---|---|
| 1,036,544 | 8/1912 | Bath | 125/11 R |
| 1,371,484 | 3/1921 | Howard | 269/8 |
| 2,280,437 | 4/1942 | Zevesque | 269/8 X |
| 2,289,458 | 7/1942 | Rodgers | 269/8 |
| 2,337,248 | 12/1943 | Koller | 269/8 |
| 2,337,249 | 12/1943 | Koller | 125/11 R |
| 3,033,144 | 5/1962 | Schmidt | 269/8 |
| 3,301,247 | 1/1967 | Pasowicz | 125/11 R |

FOREIGN PATENT DOCUMENTS

| | | | |
|---|---|---|---|
| 2274811 | 1/1976 | France | 269/8 |

*Primary Examiner*—Harold D. Whitehead

[57] ABSTRACT

A detachable magnetic base for a machine tool table is described having a permanent magnet for contact with the table, a body member thereabove for securing auxiliary devices thereto, and a manually adjustable bolt passing through the body member and magnet to engage the table and release the magnet for removal or to disengage from the table and permit the magnetic base to become affixed to the table. Other uses are described.

6 Claims, 7 Drawing Figures

DETACHABLE MAGNETIC BASE FOR MACHINE TOOL TABLE

The present invention relates to a detachable magnetic base for a machine tool table, and more particularly, to a detachable magnetic base which is adapted to support a variety of auxiliary or accessory devices securely on a machine tool table during operation and to be readily detached therefrom when not in use.

BACKGROUND OF THE INVENTION

In the production of machined metal parts and especially in the finishing thereof to close tolerances, as by grinding wheels, the machine tools utilized are normally provided with a base for supporting the workpiece and occasionally used accessory devices.

The more sophisticated machine tools utilized for such purposes are provided with magnetic tables which are magnetically energized to hold the workpiece and accessories in place on the table during operation.

However, such magnetically energized tables are expensive in terms of capital investment and also costly to operate over long periods of time. Consequently, a large number of precision machine tools having non-magnetic ferrous bases are used in combination with mechanical clamping devices for securing the workpieces thereto. When it is desired to use with such tables accessories, such as dressing means, gauges, lights, indicators and the like, it is necessary to utilize separate means for affixing the same to the table of the machine, usually on a temporary basis.

It has become common practice for this purpose to use magnetic bases or stands which can be secured to the table when needed to support the desired accessory and detached therefrom when no longer required.

Many of the magnetic bases provided for this purpose are rather expensive due to sophisticated mechanisms built therein to make or break the magnetic field between the magnetic base and the table.

There is thus need for a detachable magnetic base of simple and economic construction which will nevertheless meet the needs of the machine tool industry.

SUMMARY OF THE INVENTION

In the present invention there is provided a simple, yet novel magnetic base having a permanent magnet for contact with a machine tool table, a body member thereabove for securing auxiliary devices thereto, and a manually adjustable bolt passing through the body member and magnet to engage the table and release the magnet for removal or to disengage from the table and permit the magnetic base to become affixed to the table.

The body member of the magnetic base can be used to support a wide variety of accessory devices above the table, such as measuring gauges or indicators, clamps, and diamond tipped dressing jigs, such as that disclosed in co-pending U.S. Ser. No. 046,615 filed June 8, 1979.

The magnetic base may also be used itself as a clamping device for aligning different parts, in a manner to be hereinafter described.

The invention will be more fully understood by the following more detailed description in relation to the accompanying drawings, in which.

DETAILED DESCRIPTION

Figure 1:
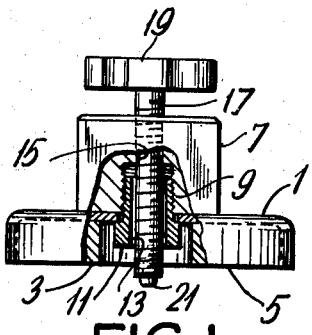
FIG. 1 is a front elevational view, partly in section, of the magnetic base of this invention, the rear and end views being the same.

The magnetic base of this invention is essentially comprised of two parts, namely an inverted cup shaped member number 1 which forms a housing for an annular-shaped magnetic material 3 securely retained therein and forming a flat lower surface 5 adapted to be placed on the table of a machine tool; and an upper body portion 7 comprising a non-magnetic material such as aluminum, securely affixed to the base member 1.

The magnetic material 3 within the inverted cup-shaped member 1 comprises a permanently magnetized material, such as an "ALNICO" magnet which is well-known in the art, forming flat surface 5.

The cup-shaped member 1 is permanently affixed to the body member 7 by means of a hollow bolt 9 threadably attached to body member 7 by means of a hexagonal head 11 and provided with a central hole 13 extending therethrough from one end to the other.

The body member 7 is provided with a centrally threaded hole 15 to cooperate with another threaded bolt 17, the purpose of which is to engage the permanent magnet 3 with the machine tool table securely and to disengage the same from the table as desired.

To accomplish this result, bolt 17 is provided at its upper end with a manually operated knob 19 to advance bolt 17 toward the table or retract the same therefrom.

The other end of bolt 17 is provided with a tip member 21 comprising a material softer than that of the machine tool table with which it is adapted to be used. Since most machine tool tables are constructed of steel, the tip 21 may be constructed of nylon, teflon, brass, aluminum or high density polyethylene, and may be secured to bolt 17 by providing the same with a cavity and swaging the bolt to tip 21 within such cavity.

Figure 2:
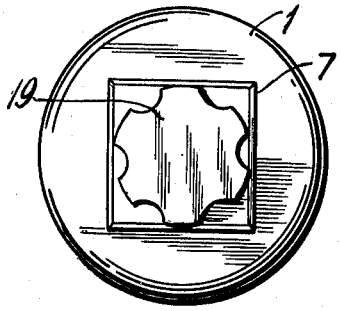
FIG. 2 is a top plan view thereof.
Figure 3:
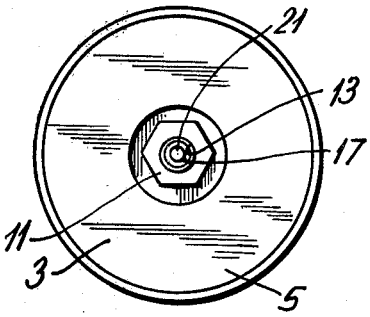
FIG. 3 is a bottom plan view thereof.

It will be seen from FIGS. 1, 2 and 3 that bolt 17 is operably carried by body member 7 which in cooperation therewith permits advancing of the bolt toward the table and retraction of the bolt therefrom. The tolerances between bolt 17 and the inner periphery of bolt 9 defining hole 13 are such that bolt 17 freely passes through the hole 13 of bolt 9 without disturbing the secure connection between inverted cup 1 and body member 7.

When magnetic bases are secured to steel tables of various machine tools, it is very difficult to detach them from the table if the base magnetism is sufficiently strong to firmly affix the same to the table. In the present invention, the magnetic base described above may readily be attached to the machine tool table, but also may readily be detached therefrom manually by simply turning knob 19 to advance tip 21 against the table and thereby break the magnetic contact, without damage to the table.

The magnetic base of the present invention therefore has many applications and in particular can be utilized for supporting numerous accessory tools which are utilized during machine tool operations. For this purpose body member 7 which is illustratively shown as rectangular in shape may be provided on at least one face thereof with at least one threaded hole to receive detachable means for securing accessory tools thereto.

Such accessory tools, as previously indicated may be gauges, lights, auxiliary clamps, diamond dressing jigs and in fact any device which may be intermittently used in machine tool operation.

Figure 4:
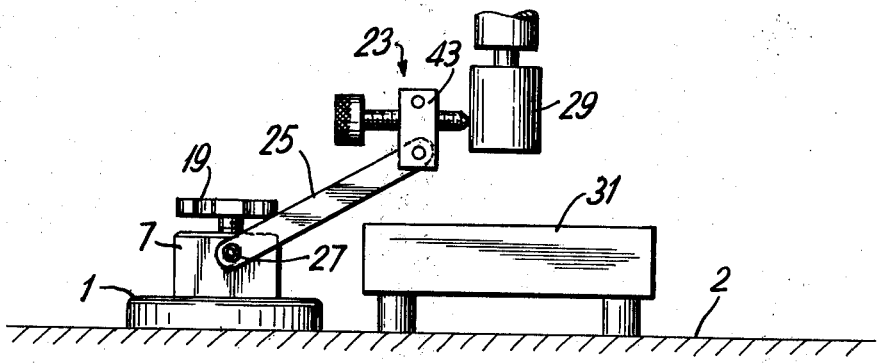
FIG. 4 is an elevational view thereof supporting a diamond dressing jig on a machine tool table.

As previously pointed out, the magnetic base of the present invention may be utilized to support a diamond dressing jig for dressing grinding wheels, as set forth in co-pending U.S. application Ser. No. 046,615 filed June 8, 1979. A modified form of such a dressing jig is shown in FIG. 4 of the present invention wherein a dressing jig generally shown at 23 is secured to body 7 of the magnetic base by means of an arm 25 and a bolt 27. In this particular instance the dressing jig is adapted to dress a vertically disposed cylindrical grinding wheel 29 which is used to finish a hole (not shown) in a workpiece 31 therebeneath. A more detailed embodiment of the dressing jig 23 of FIG. 4 will be hereinafter described.

Figure 5:
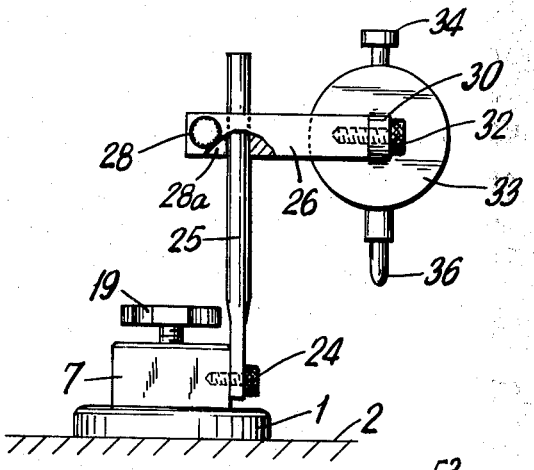
FIG. 5 is an elevational view thereof partly in section supporting a measuring gauge on a machine tool table.

Another application of the magnetic base of the present invention is shown in FIG. 5 wherein the body member 7 supports an arm or rod 25 adjustably attached thereto and adapted to swivel with respect thereto by means of a machine screw 24 provided with a knurled knob for manual operation. Rod 25 is flattened at its base to facilitate secure attachment thereof to body member 7. Rod 25 serves as a stanchion for support of a cross-bar member 26 and a gauge 33 for the purpose of measuring the thickness of a workpiece (not shown) in relation to the top of supporting machine tool table 2. Cross-bar 26 is at one end adjustably clamped to rod 25 by means of a manually operable machine screw 28 provided with a knurled knob and running above a slot 28*a*.

Gauge 33 may be any of the various types known in the art for the intended purpose, the dial side of which is not shown. The back of gauge 33 is provided with an outwardly extending flangelike support member 30 provided with a hole adapted to receive another manually adjustable machine screw 32 provided with a knurled knob. Screw 32 engages a corresponding longitudinal threaded hole in cross-bar 26 to securely affix the gauge 33 to the cross-bar in any desired position. Support member 30 extends outwardly from the back of gauge 33 sufficiently to permit the gauge to swivel about cross-bar 26 to any desired position for measurement purposes.

Measurement readings are accomplished by adjusting the gauge to the desired position and calibration; then lifting a knob 34 on top of the gauge, which in turn lifts a workpiece-engaging tip 36 to permit clearance between the workpiece and tip 36; and thereafter releasing knob 34 to permit contact with the workpiece and measurement thereof.

Figure 6:
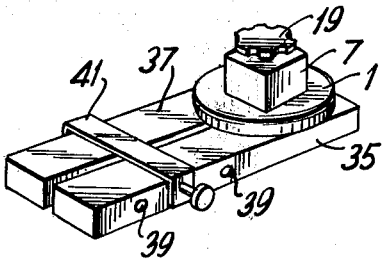
FIG. 6 is a perspective view showing its use in aligning two workpieces together.

The magnetic base of the present invention may also be utilized as, for example, in FIG. 6 to align together two workpieces 35 and 37 for the purpose of drilling holes 39 therethrough, in which connection the alignment may be assisted by an auxiliary clamp 41 if desired.

Figure 7:
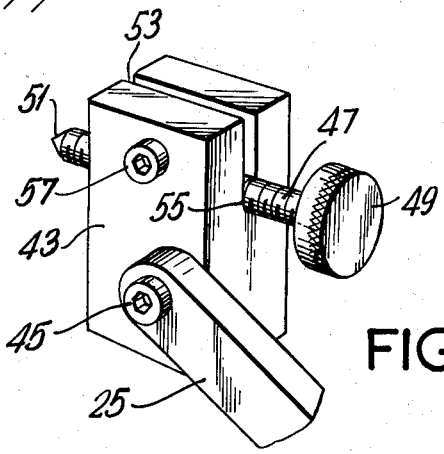
FIG. 7 is a perspective view showing in greater detail the adjustable diamond holder of FIG. 4.

The magnetic base of the present invention is especially useful in the dressing of grinding wheels as illustrated in FIG. 4 described above. In this connection a more detailed illustration of the diamond dressing jig is shown in FIG. 7, wherein arm 25 supports a further body member 43 by means of a bolt 45. Body member 43 is provided with a threaded hole 55 passing therethrough and adapted to receive an adjustable screw 47 provided at one end with a knurled knob 49 for turning the same in the clockwise or counter-clockwise direction; and at the other end with a diamond tip 51 for dressing the grinding wheel; for example, wheel 29 of FIG. 4. The top of body member 43 is provided with a slot 53 passing therethrough and intercepting the threaded hole 55, which receives screw 47, in a longitudinal direction with respect to both the screw 47 and the threaded hole 55. Screw 47 may thus be freely rotated within the threaded hole 55.

Once screw 47 is properly set to the position desired for dressing the grinding wheel 29 a bolt 57 passing through body member 43 and bridging slot 53 is tightened to securely lock screw 47 in place. This construction readily provides a means for freely turning a screw or bolt to the desired position and locking the same firmly in place to achieve a number of different purposes in machine tool operations.

Having thus described the present invention and the most preferred embodiments thereof, it will be evident that many modifications can be made to the device described, and that resort may be had to such modifications and equivalence as fall within the spirit of the invention and the scope of the appended claims hereinafter made.

I claim:

1. A magnetic base for detachably securing auxililary devices to a ferrous metal table of a machine tool comprising a substantially flat base member containing a permanently magnetized material adapted to adhere securely to said table and provided with a central hole therein, a body member securely affixed thereabove to said magnetic base member for supporting said devices, means for affixing said body member to said base member comprising a first threaded bolt provided with a central hole therein passing therethrough from one end to the other, said body member being provided with an upper threaded hole aligned with the hole in said bolt and adapted to receive a second threaded bolt for disengaging said magnetic base from said table, and a second threaded bolt in said upper threaded hole provided at the top thereof with a manually operable means for turning the same, and at the bottom thereof with a material softer than that of said table for engagement therewith, whereby upon advancing or retracting said second threaded bolt with respect to said table, said base may be either disengaged from said table or placed in magnetic engagement therewith.

2. A magnetic base according to claim 1, wherein said body member is provided with at least four upstanding faces, each of which is provided with at least one threaded hole adapted to receive a device to be affixed to said table.

3. A magnetic base according to claim 2, wherein an arm is affixed to said body member to support a gauge for measuring the tolerances of a workpiece supported by said table.

4. A magnetic base according to claim 2, wherein an arm is affixed to said body member to support a diamond tipped jig for dressing a grinding wheel.

5. A device according to claim 4, wherein the jig comprises an upwardly extending arm, one end of which is adjustably affixed to said body member and the other end of which is adjustably affixed to a second body member, said second body member being provided with a longitudinal threaded hole therethrough and a slot extending from an outer surface thereof and longitudinally intercepting said longitudinal hole, an adjustable threaded bolt within said longitudinally threaded hole extendable through said second body member and provided at one end with a diamond tip for dressing a grinding wheel and at the other end with manual means for advancing and retracting said bolt, and means extending transversely with respect to said slot for compressing and tightening said threaded hole about said adjustable bolt for locking the same in a predetermined position.

6. A device according to claim 5, wherein said means for tightening said threaded hole comprises a bolt extending transversely with respect to said slot.

* * * * *